US012460341B2

(12) United States Patent
Rasco

(10) Patent No.: US 12,460,341 B2
(45) Date of Patent: Nov. 4, 2025

(54) WASHING MACHINE DEVICE

(71) Applicant: Anita Rasco, Athens, TX (US)

(72) Inventor: Anita Rasco, Athens, TX (US)

( * ) Notice: Subject to any disclaimer, the term of this patent is extended or adjusted under 35 U.S.C. 154(b) by 179 days.

(21) Appl. No.: 18/526,853

(22) Filed: Dec. 1, 2023

(65) Prior Publication Data

US 2025/0179717 A1 Jun. 5, 2025

(51) Int. Cl.

| | |
|---|---|
| ***D06F 39/08*** | (2006.01) |
| ***D06F 13/02*** | (2006.01) |
| ***D06F 23/04*** | (2006.01) |
| ***D06F 39/12*** | (2006.01) |

(52) U.S. Cl.

CPC ..... *D06F 39/083* (2013.01); *D06F 13/02* (2013.01); *D06F 23/04* (2013.01); *D06F 39/085* (2013.01); *D06F 39/088* (2013.01); *D06F 39/12* (2013.01)

(58) Field of Classification Search

CPC ..... D06F 13/02; D06F 23/04; D06F 39/10; D06F 39/12; D06F 39/083; D06F 39/085; D06F 39/088

See application file for complete search history.

(56) References Cited

U.S. PATENT DOCUMENTS

| | | | | |
|---|---|---|---|---|
| D168,292 | S | 12/1952 | Dreyfuss | |
| 2,869,348 | A | 1/1959 | Shelton | |
| 2,927,451 | A | 3/1960 | Bochan | |
| 3,246,837 | A | 4/1966 | Douglas | |
| 4,168,615 | A | 9/1979 | Condit | |
| 4,357,812 | A | 11/1982 | Braga | |
| 4,848,105 | A | 7/1989 | O'Connell | |
| 5,857,362 | A * | 1/1999 | Oh | D06F 39/083 68/148 |
| 2017/0030002 | A1* | 2/2017 | Alexander | D06F 23/04 |
| 2020/0299891 | A1* | 9/2020 | Lao | D06F 23/04 |

FOREIGN PATENT DOCUMENTS

| | | |
|---|---|---|
| WO | WO2009134070 | 11/2009 |

* cited by examiner

*Primary Examiner* — Joseph L. Perrin

(57) ABSTRACT

A washing machine device includes a washing machine that has an overfill tub, an outer tub nested in the overfill tub and an inner tub nested in the outer tub; the inner tub contains dirty clothing for washing. The inner tub is filled with water for washing the dirty clothing and the inner tub is foraminous thereby facilitating each of the outer tub and the inner tub to be filled with water during a washing cycle. Each of the inner tub and the outer tub are overfilled with the water when the washing machine is actuated into a drain cycle such that the overfill tub receives debris and contaminants that have floated to the top of the water in the inner tub and the outer tub. In this way the debris and contaminants do not have to pass through the clothing to be drained from the inner tub.

10 Claims, 9 Drawing Sheets

WASHING MACHINE DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to washing devices and more particularly pertains to a new washing devices for draining debris and contaminants from a washing machine without exposing clothing to the debris and contaminants. The device includes a washing machine that has an overfill tub, an outer tub nested in the overfill tub and an inner tub nested in the outer tub. The inner tub is foraminous such that the outer tub and the inner tub are both filled with water during a wash cycle. The outer tub and the inner tub are overfilled to facilitating debris and contaminants that have floated to the top of the water in the outer tub and the inner tub to be collected in the overfill tub. The debris and contaminants are drained from the overfill tub thereby inhibiting the clothing in the inner tub from being exposed to the debris and contaminants.

(2) Description of Related Art Including Information Disclosed Under 37 CFR 1.97 and 1.98

The prior art relates to washing devices including a variety of washing machines that each at least includes a sediment collection and ejection element for capturing and ejecting sediment from a load of laundry and a variety of washing machines that each at least includes a recirculation system for recirculating water in the washing machines for washing and rinsing cycles. In no instance does the prior art disclose a washing machine that has an overfill tub in which an outer tub and an inner tube are nested and which captures debris and contaminants that have floated on top of water in the outer tub and the inner tub when the outer tub and inner tub are overfilled thereby facilitating the debris and contaminants to be drained from the overfill tub without exposing the laundry in the inner tub to the debris and contaminants.

BRIEF SUMMARY OF THE INVENTION

An embodiment of the disclosure meets the needs presented above by generally comprising a washing machine that has an overfill tub, an outer tub nested in the overfill tub and an inner tub nested in the outer tub; the inner tub contains dirty clothing for washing. The inner tub is filled with water for washing the dirty clothing and the inner tub is foraminous thereby facilitating each of the outer tub and the inner tub to be filled with water during a washing cycle. Each of the inner tub and the outer tub are overfilled with the water when the washing machine is actuated into a drain cycle such that the overfill tub receives debris and contaminants that have floated to the top of the water in the inner tub and the outer tub. In this way the debris and contaminants do not have to pass through the clothing to be drained from the inner tub.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
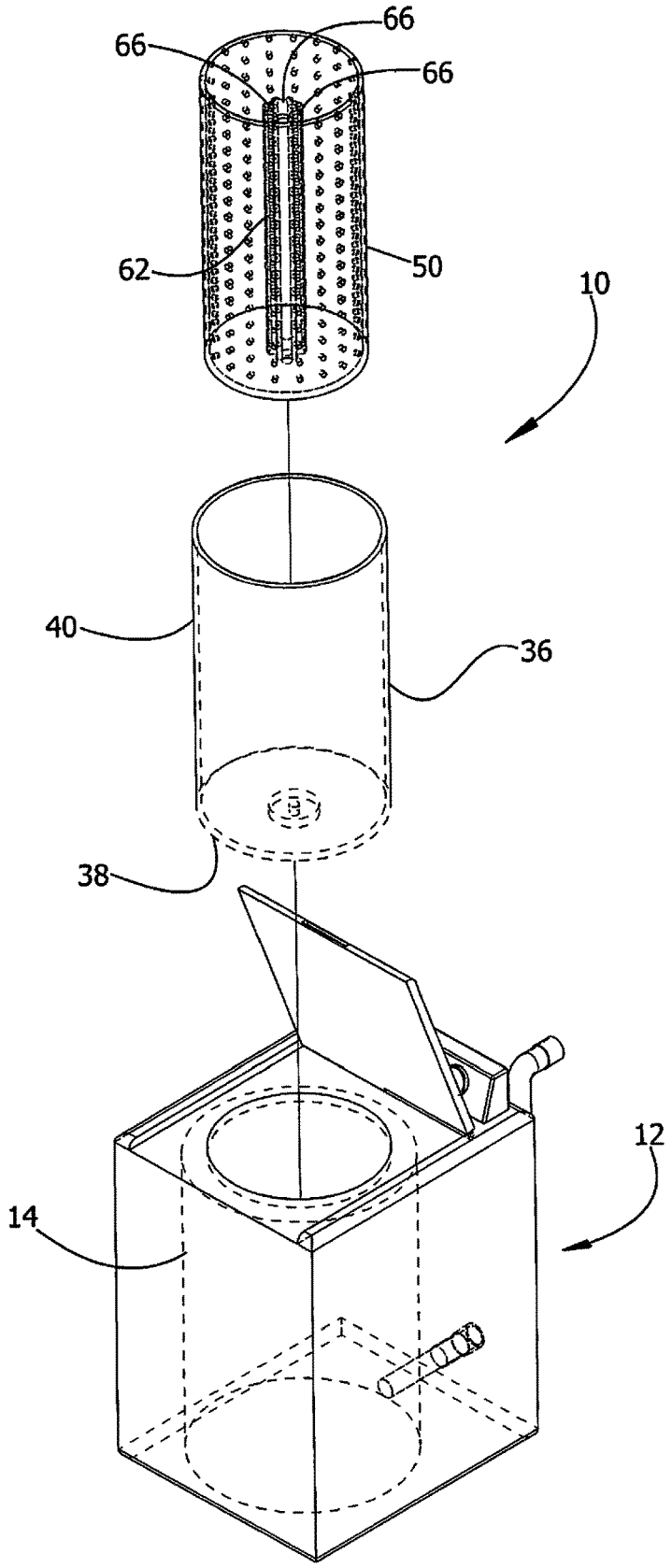
FIG. 1 is an exploded perspective view of a washing machine device according to an embodiment of the disclosure.
Figure 2:
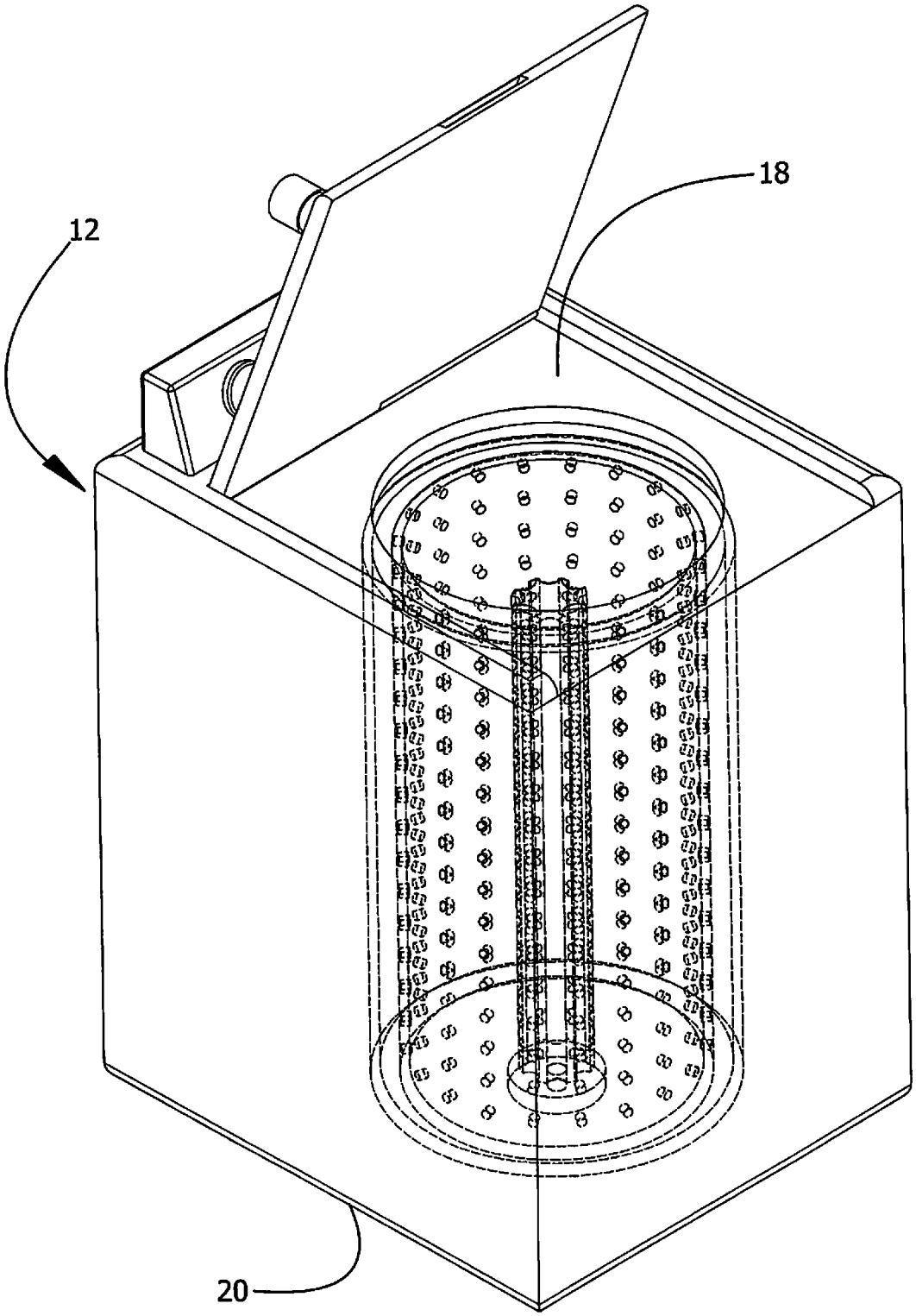
FIG. 2 is a phantom perspective view of an embodiment of the disclosure.
Figure 3:
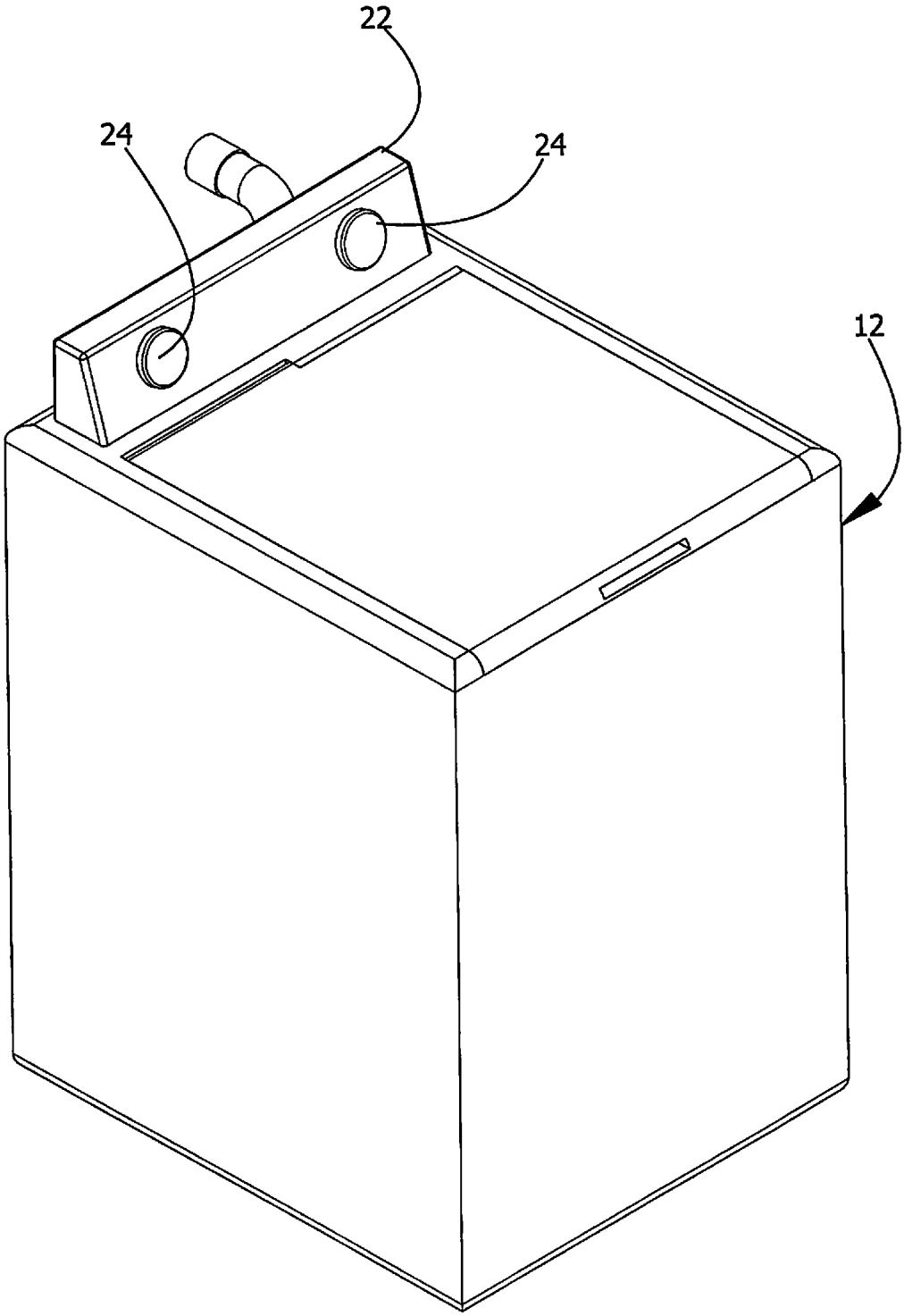
FIG. 3 is a top perspective view of an embodiment of the disclosure.
Figure 4:
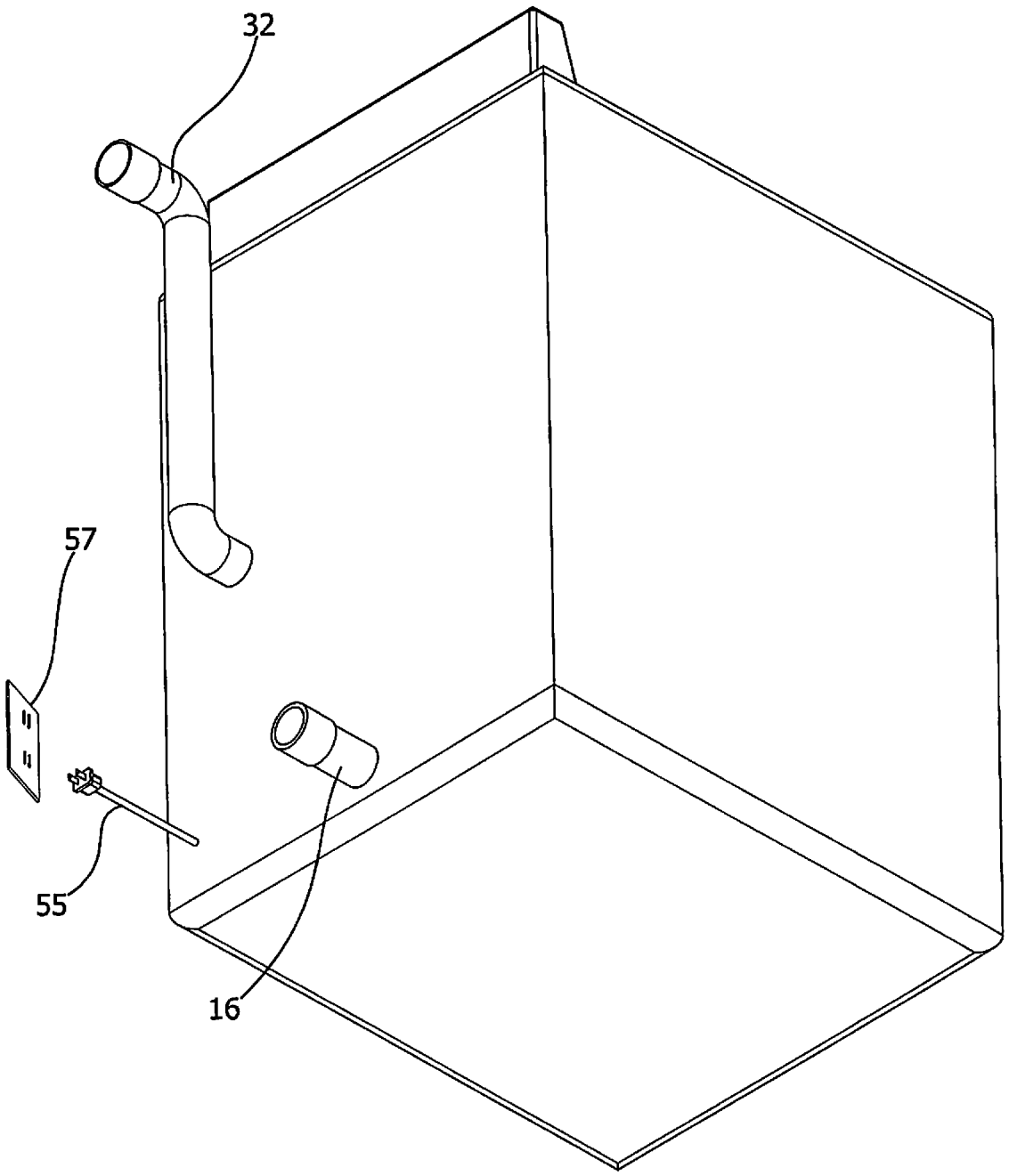
FIG. 4 is a bottom perspective view of an embodiment of the disclosure.
Figure 5:
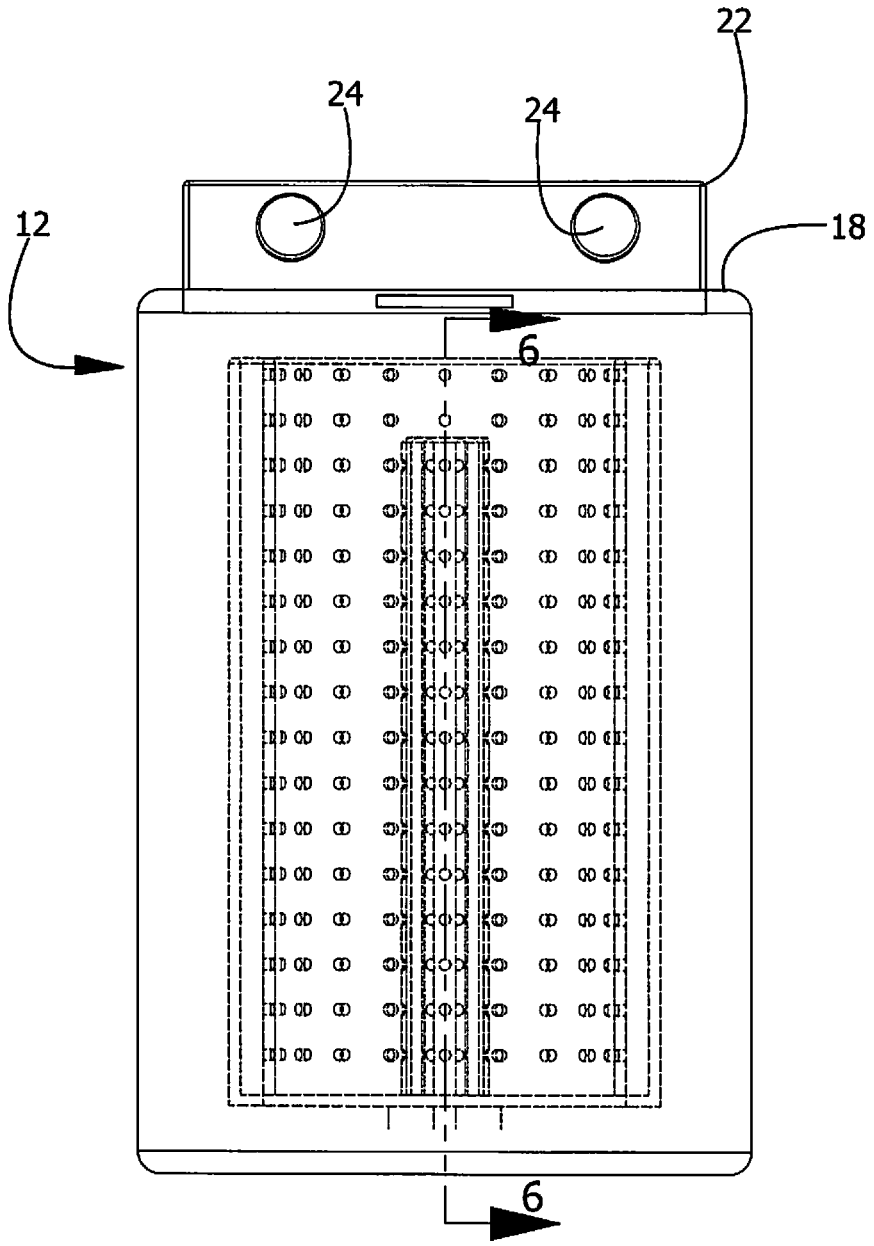
FIG. 5 is a front phantom view of an embodiment of the disclosure.
Figure 6:
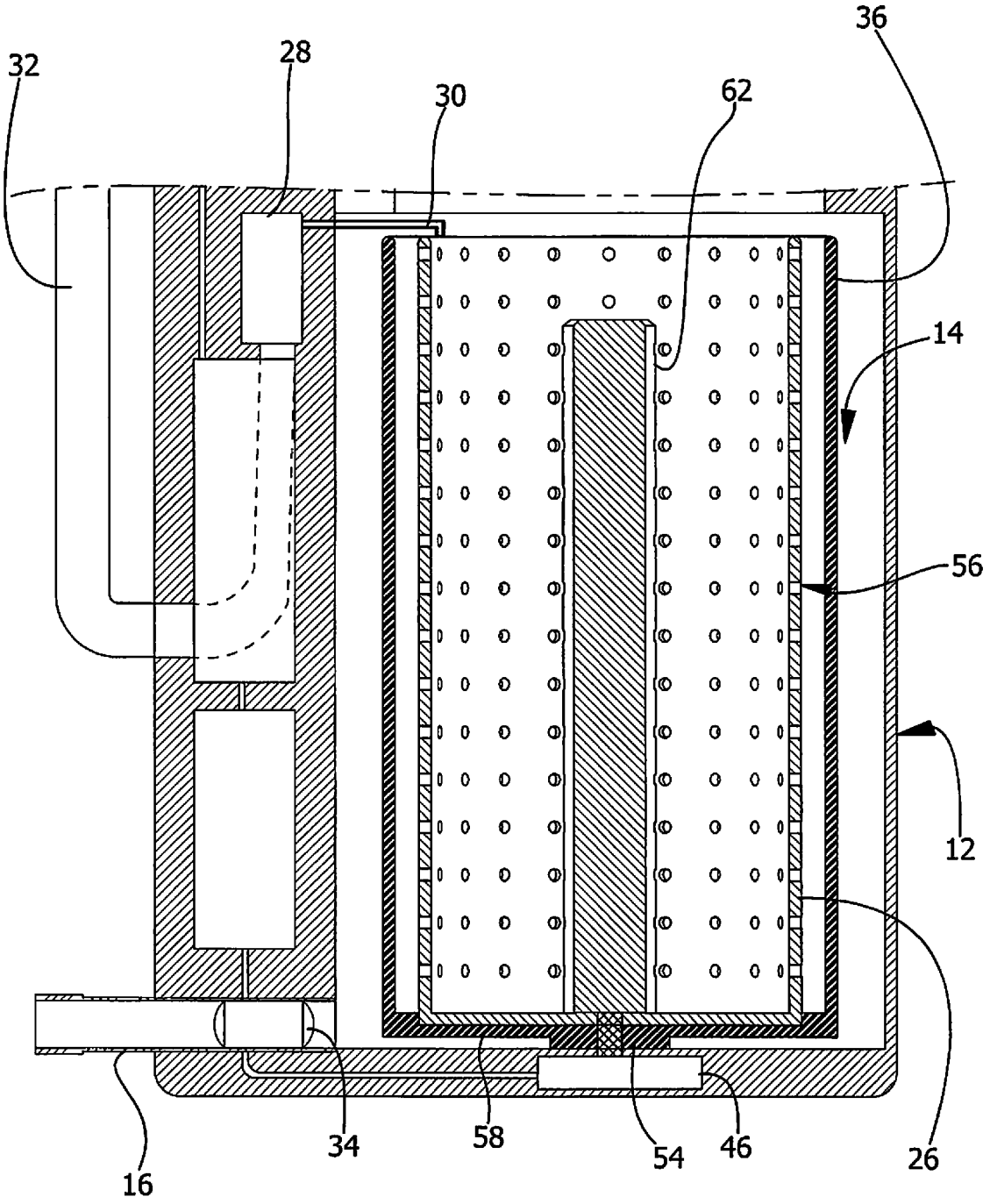
FIG. 6 is a cross sectional view taken along line 6-6 of FIG. 5 of an embodiment of the disclosure.
Figure 7:
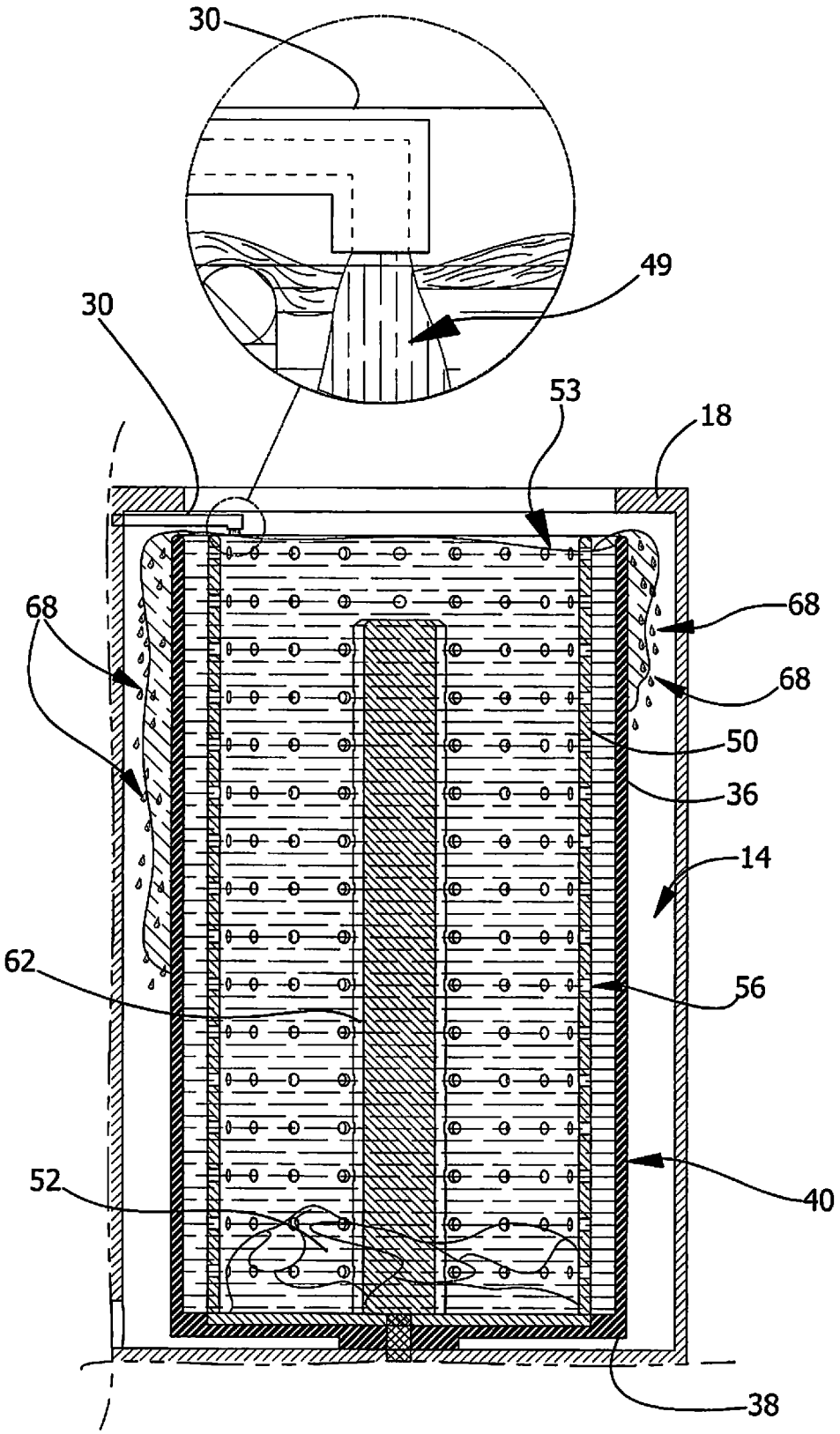
FIG. 7 is a cross sectional view taken along line 6-6 of FIG. 5 of an embodiment of the disclosure showing an outer tub and an inner tub being overfilled to facilitate debris and contaminants to be collected in an overfill tub.
Figure 8:
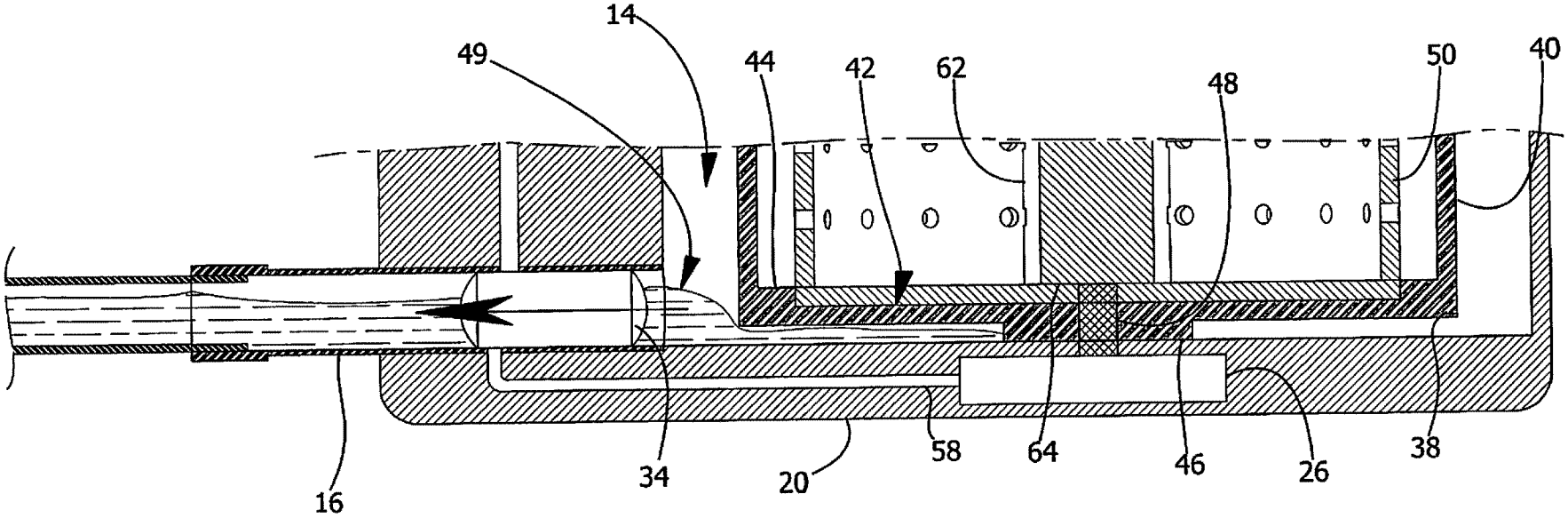
FIG. 8 is a magnified detail view of an embodiment of the disclosure showing a drain pump draining water from an overfill tub.

With reference now to the drawings, and in particular to FIGS. 1 through 9 thereof, a new washing devices embodying the principles and concepts of an embodiment of the disclosure and generally designated by the reference numeral 10 will be described.

As best illustrated in FIGS. 1 through 9, the washing machine device 10 generally comprises a washing machine 12 that has an overfill tub 14 which is integrated into the washing machine 12 and the washing machine 12 has a drain 16 that is in fluid communication with the overfill tub 14. The overfill tub 14 extends from a top wall 18 of the washing machine 12 toward a lower wall 20 of the washing machine 12 and the washing machine 12 has a control panel 22 extending upwardly from the top wall 18 for accommodating control knobs 24 of the washing machine 12. The washing machine 12 has a drive motor 26 that is integrated into the lower wall 20 and the washing machine 12 has a water pump 28 which has an output tube 30 extending across the overfill tub 14. The drive motor 26 may comprise an electric drive motor that is common to electronic washing machines and the water pump 28 may comprise an electric water pump.

The washing machine 12 has a water pipe 32 that is in fluid communication with the water pump 28 and the water pipe 32 extends away from the washing machine 12. The drain 16 is aligned with the lower wall 20 of the washing machine 12 and the drain 16 includes a drain pump 34. Additionally, the drain pump 34 may be an electric water pump or the like that is in a normally closed condition such that the drain pump 34 inhibits water from flowing through the drain pump 34 unless the drain pump 34 is turned on.

An outer tub 36 is nested in the overfill tub 14 and the outer tub 36 has a bottom wall 38 and an exterior wall 40 extending upwardly from the bottom wall 38; the exterior wall 40 is continuously arcuate about a center of the bottom wall 38 such that the outer tub 36 has a cylindrical shape. The bottom wall 38 has a recess 42 extending into a top surface 44 of the bottom wall 38 and the recess 42 is centrally located on the bottom wall 38 and is oriented concentric with the exterior wall 40. The bottom wall 38 has a collar 46 extending downwardly from the bottom wall 38 which is centrally located on the bottom wall 38 and the collar 46 receives an output shaft 48 of the drive motor 26 in the bottom wall 38 of the washing machine 12.

An inner tub 50 is nested in the outer tub 36 and the inner tub 50 can contain dirty clothing 52 for washing. The inner tub 50 is filled with water 49 when the washing machine 12 is actuated into a washing cycle to facilitate the dirty clothing 52 to be washed. Furthermore, the inner tub 50 is foraminous thereby facilitating each of the outer tub 36 and the inner tub 50 to be filled with water 49 during the washing cycle. The inner tub 50 has a basal wall 54 and an outer wall 56 extending upwardly from the basal wall 54; the outer wall 56 is continuously arcuate about a center of the basal wall 54 such that the inner tub 50 has a cylindrical shape and the outer wall 56 is foraminous. The basal wall 54 rests in the recess 42 in the bottom wall 38 of the outer tub 36 having the output shaft 48 of the drive motor 26 extending through the basal wall 54. The drive motor 26 includes a fluid conduit 58 which is in fluid communication with the outer tub 36 and the drain pump 34. In this way the drain pump 34 can drain the water 49 from the inner tub 50 and the outer tub 36 when the washing machine 12 is actuated into a drain cycle.

Figure 9:
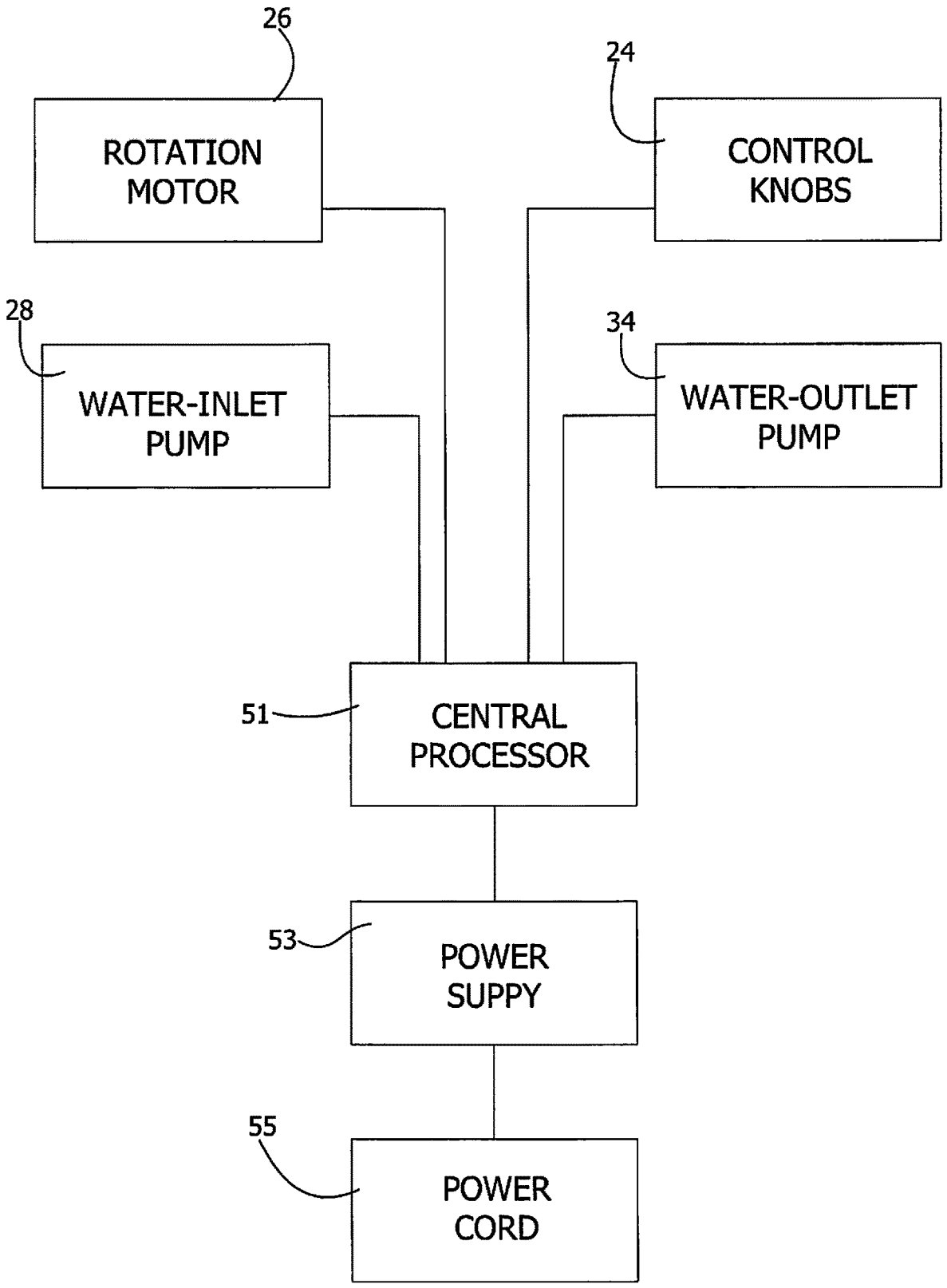
FIG. 9 is a schematic view of an embodiment of the disclosure.

The inner tub 50 is aligned with the output tube 30 of the water pump 28 thereby facilitating the output tube 30 to fill the inner tub 50 with water 49 which flows through the outer wall 56 to also fill the outer tub 36. As is shown in FIG. 9, the washing machine 12 may include a processor 51 that is electrically coupled to each of the control knobs 24 and the drive motor 26 and the water pump 28 and the drain pump 34. Additionally, the washing machine 12 may include a power supply 53 that is electrically coupled to the processor 51 and a power cord 55, electrically coupled to the power supply 53, which extends away from the washing machine 12 and which can be plugged into a power source 57 comprising a female electrical outlet.

An agitator 62 is rotatably disposed on the basal wall 54 of the inner tub 50 and the agitator 62 is vertically oriented. A lower end 64 of the agitator 62 is coupled to the output shaft 48 of the drive motor 26 such that the drive motor 26 rotates the agitator 62 about a vertical axis. In this way the agitator 62 can agitate the dirty clothing 52 in the water 49 to wash the dirty clothing 52. The agitator 62 may be structured to have a plurality of depressions 66 each extending vertically along a full length of the agitator 62 to facilitate the agitator 62 to engage the dirty clothing 52 for more thoroughly agitating the dirty clothing 52 in the water 49. The washing machine 12 may be a commercial or residential washing of any conventional design and may be manufactured by any manufacturer of household appliances.

The water pump 28 is actuated to fill the inner tub 50 and the outer tub 36 with water 49 when the washing machine 12 is actuated into either of the washing cycle or a rinsing cycle to wash the dirty clothing 52. The water pump 28 is actuated to overfill the inner tub 50 and the outer tub 36 with water 49 when the washing machine 12 is actuated into a first drain cycle such that the water 49 runs into the overfill tub 14. In this way the overfill tub 14 can receive debris and contaminants 68, previously embedded in the dirty clothing 52, that have floated to the top of the water 49 in the inner tub 50 and the outer tub 36. The drain pump 34 is actuated to pump the water 49 from the overfill tub 14 and outwardly through the drain 16 pipe when the washing machine 12 is actuated into a first drain cycle. In this way the drain pump 34 removes the debris and contaminants 68 from the washing machine 12 without having the debris and contaminants 68 pass through the clothing 52 as occurs in the conventional means of draining dirty water from washing machines. The drain pump 34 is actuated to pump the water 49 through the fluid conduit 58 integrated into the drive motor 26 and outwardly through the drain 16 pipe when the washing machine 12 is actuated into a second drain cycle thereby facilitating water 49 employed for rinsing to be drained from the outer tub 36 and the inner tub 50.

In use, the dirty clothing 52 is placed in the inner tub 50 and the control knobs 24 on the washing machine 12 are manipulated to actuate the washing machine 12 into a desired wash cycle. Each of the inner tub 50 and the outer tub 36 are filled with water 49 during the initial wash cycle and each of the inner tub 50 and the outer tub 36 are overfilled with water 49 when the wash cycle is complete. In this way debris and contaminants 68 that have floated to the top of the water 49 during the wash cycle are collected in the overfill tub 14 for subsequent draining through the drain 16. Thus, the debris and contaminants 68 do not have pass through the clothing 52 during the draining process as is common with existing washing machines. The drain pump 34 drains the mixture of water 49 and debris and contaminants 68 from the overfill tub 14 until the overfill tub 14 is emptied. The drain pump 34 subsequently drains the water 49 in the outer tub 36 and the inner tub 50 through the fluid conduit 58 associated with the drive motor 26 to facilitate the inner tub 50 and the outer tub 36 to be re-filled with water 49 for a rinsing cycle. The drain pump 34 drains the water 49 through the fluid conduit 58 associated with the drive motor 26 when the rinsing cycle is complete.

With respect to the above description then, it is to be realized that the optimum dimensional relationships for the parts of an embodiment enabled by the disclosure, to include variations in size, materials, shape, form, function and manner of operation, device and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A washing machine device which includes an overfill tub which receives water and debris from an inner tub to facilitate the water and debris to be drained, said device comprising:

a washing machine having an overfill tub being integrated into said washing machine, said washing machine having a drain being in fluid communication with said overfill tub;

an outer tub being nested in said overfill tub;

an inner tub being nested in said outer tub wherein said inner tub is configured to contain dirty clothing for washing, said inner tub being filled with water when said washing machine is actuated into a washing cycle wherein said inner tub is configured to facilitate the dirty clothing to be washed, said inner tub being foraminous thereby facilitating each of said outer tub and said inner tub to be filled with water during said washing cycle;

wherein each of said inner tub and said outer tub are filled with water when said washing machine is actuated into a washing cycle wherein said washing machine is configured to wash the dirty clothing; and wherein each of said inner tub and said outer tub are overfilled with the water when said washing machine is actuated into a drain cycle wherein said overfill tub is configured to receive debris and contaminants that have floated to the top of the water in said inner tub and said outer tub thereby inhibiting the debris and contaminants from having to pass through the clothing to be drained from said inner tub.

2. The device according to claim 1, wherein:

said overfill tub extends from a top wall of said washing machine toward a lower wall of said washing machine;

said washing machine has a control panel extending upwardly from said top wall for accommodating control knobs of said washing machine;

said washing machine has a drive motor being integrated into said lower wall;

said washing machine has a water pump which has an output tube extending across said overfill tub;

said washing machine has a water pipe being in fluid communication with said water pump, said water pipe extending away from said washing machine;

said drain is aligned with said lower wall of said washing machine;

said drain includes a drain pump; and said drive motor includes a fluid conduit which is in fluid communication with said outer tub and said drain pump thereby facilitating said drain pump to drain the water from said inner tub and said outer tub when said washing machine is actuated into a drain cycle.

3. The device according to claim 2, wherein said water pump is actuated to fill said inner tub and said outer tub with water when said washing machine is actuated into either of said washing cycle or a rinsing cycle wherein said washing machine is configured to wash the dirty clothing.

4. The device according to claim 2, wherein said water pump is actuated to overfill said inner tub and said outer tub with water when said washing machine is actuated into a first drain cycle such that the water runs into said overfill tub wherein said overfill tub is configured to receive debris and contaminants that have floated to the top of the water in said inner tub and said outer tub.

5. The device according to claim 2, wherein said drain pump is actuated to pump the water from said overfill tub and outwardly through said drain pipe when said washing machine is actuated into a first drain cycle wherein said drain pump is configured to remove the debris and contaminants from said overfill tub.

6. The device according to claim 5, wherein said drain pump is actuated to pump the water through said fluid conduit integrated into said drive motor and outwardly through said drain pipe when said washing machine is actuated into a second drain cycle thereby facilitating water employed for rinsing to be drained from said outer tub and said inner tub.

7. The device according to claim 1, wherein:

said washing machine has a drive motor being integrated into a lower wall of said washing machine;

said outer tub has a bottom wall and an exterior wall extending upwardly from said bottom wall;

said exterior wall is continuously arcuate about a center of said bottom wall such that said outer tub has a cylindrical shape;

said bottom wall has a recess extending into a top surface of said bottom wall, said recess being centrally located on said bottom wall and being oriented concentric with said exterior wall;

said bottom wall has a collar extending downwardly from said bottom wall which is centrally located on said bottom wall; and said collar receives an output shaft of said drive motor in said bottom wall of said washing machine.

8. The device according to claim 7, wherein:

said inner tub has a basal wall and an outer wall extending upwardly from said basal wall;

said outer wall is continuously arcuate about a center of said basal wall such that said inner tub has a cylindrical shape;

said outer wall is foraminous;

said basal wall resting in said recess in said bottom wall of said outer tub having said output shaft of said drive motor extending through said basal wall; and said inner tub being aligned with said output tube of said water pump thereby facilitating said output tube to fill said inner tub with water which flows through said outer wall to also fill said outer tub.

9. The device according to claim 8, further comprising an agitator being rotatably disposed on said basal wall of said inner tub having said agitator being vertically oriented, a lower end of said agitator being coupled to said output shaft of said drive motor such that said drive motor rotates said agitator about a vertical axis wherein said agitator is configured to agitate the dirty clothing in the water to wash the dirty clothing.

10. A washing machine device which includes an overfill tub which receives water and debris from an inner tub to facilitate the water and debris to be drained, said device comprising:

a washing machine having an overfill tub being integrated into said washing machine, said washing machine having a drain being in fluid communication with said overfill tub, said overfill tub extending from a top wall of said washing machine toward a lower wall of said washing machine, said washing machine having a control panel extending upwardly from said top wall for accommodating control knobs of said washing machine, said washing machine having a drive motor being integrated into said lower wall, said washing machine having a water pump which has an output tube extending across said overfill tub, washing machine having a water pipe being in fluid communication with said water pump, said water pipe extending away from said washing machine, said drain being aligned with said lower wall of said washing machine, said drain including a drain pump, said drive motor including a fluid conduit which is in fluid communication with said outer tub and said drain pump thereby facilitating said drain pump to drain the water from said inner tub and said outer tub when said washing machine is actuated into a drain cycle;

an outer tub being nested in said overfill tub, said outer tub having a bottom wall and an exterior wall extending upwardly from said bottom wall, said exterior wall being continuously arcuate about a center of said bottom wall such that said outer tub has a cylindrical shape, said bottom wall having a recess extending into a top surface of said bottom wall, said recess being centrally located on said bottom wall and being oriented concentric with said exterior wall, said bottom wall having a collar extending downwardly from said bottom wall which is centrally located on said bottom wall, said collar receiving an output shaft of said drive motor in said bottom wall of said washing machine;

an inner tub being nested in said outer tub wherein said inner tub is configured to contain dirty clothing for washing, said inner tub being filled with water when said washing machine is actuated into a washing cycle wherein said inner tub is configured to facilitate the dirty clothing to be washed, said inner tub being foraminous thereby facilitating each of said outer tub and said inner tub to be filled with water during said washing cycle, said inner tub having a basal wall and an outer wall extending upwardly from said basal wall, said outer wall being continuously arcuate about a center of said basal wall such that said inner tub has a cylindrical shape, said outer wall being foraminous, said basal wall resting in said recess in said bottom wall of said outer tub having said output shaft of said drive motor extending through said basal wall, said inner tub being aligned with said output tube of said water pump thereby facilitating said output tube to fill said inner tub with water which flows through said outer wall to also fill said outer tub;

an agitator being rotatably disposed on said basal wall of said inner tub having said agitator being vertically oriented, a lower end of said agitator being coupled to said output shaft of said drive motor such that said drive motor rotates said agitator about a vertical axis wherein said agitator is configured to agitate the dirty clothing in the water to wash the dirty clothing;

wherein said water pump is actuated to fill said inner tub and said outer tub with water when said washing machine is actuated into either of said washing cycle or a rinsing cycle wherein said washing machine is configured to wash the dirty clothing;

wherein said water pump is actuated to overfill said inner tub and said outer tub with water when said washing machine is actuated into a first drain cycle such that the water runs into said overfill tub wherein said overfill tub is configured to receive debris and contaminants that have floated to the top of the water in said inner tub and said outer tub;

wherein said drain pump is actuated to pump the water from said overfill tub and outwardly through said drain pipe when said washing machine is actuated into a first drain cycle wherein said drain pump is configured to remove the debris and contaminants from said overfill tub; and wherein said drain pump is actuated to pump the water through said fluid conduit integrated into said drive motor and outwardly through said drain pipe when said washing machine is actuated into a second drain cycle thereby facilitating water employed for rinsing to be drained from said outer tub and said inner tub.

* * * * *